United States Patent [19]

Kardos et al.

[11] 4,036,710

[45] July 19, 1977

[54] ELECTRODEPOSITION OF COPPER

[75] Inventors: Otto Kardos, Ferndale; Donald A. Arcilesi, Mount Clemens; Silvester P. Valayil, Pontiac, all of Mich.

[73] Assignee: M & T Chemicals Inc., Greenwich, Conn.

[21] Appl. No.: 644,098

[22] Filed: Dec. 24, 1975

Related U.S. Application Data

[63] Continuation-in-part of Ser. No. 525,719, Nov. 21, 1974, abandoned, which is a continuation-in-part of Ser. No. 315,112, Dec. 12, 1972, abandoned.

[51] Int. Cl.[2] ..... C25D 3/38

[52] U.S. Cl. ..... 204/52 R

[58] Field of Search ..... 106/1; 204/52 R, 44

[56] References Cited

U.S. PATENT DOCUMENTS

| | | | |
|---|---|---|---|
| 2,849,351 | 8/1958 | Gündel et al. | 204/44 |
| 2,849,352 | 8/1958 | Kirstahler et al. | 204/44 |
| 3,000,800 | 9/1961 | Strauss et al. | 204/52 R |
| 3,023,150 | 2/1962 | Willmund et al. | 204/44 |
| 3,081,240 | 3/1963 | Strauss et al. | 204/52 R |
| 3,267,010 | 8/1966 | Creutz et al. | 204/52 R |
| 3,328,273 | 6/1967 | Creutz et al. | 204/52 R |
| 3,542,655 | 11/1970 | Kardos et al. | 204/52 R |
| 3,650,915 | 3/1972 | Quimby et al. | 204/52 R |
| 3,682,788 | 8/1972 | Kardos et al. | 204/52 R |
| 3,732,151 | 5/1973 | Abbott | 204/52 R |

*Primary Examiner*—G. L. Kaplan

*Attorney, Agent, or Firm*—Kenneth G. Wheeless; Robert P. Auber; Robert Spector

[57] ABSTRACT

This invention relates to novel compositions and to a process for electrodepositing copper from an aqueous acidic copper plating bath containing at least one member independently selected from each of the following two groups:

A. from 0.005 to 1.0 gram per liter of at least one member of the group consisting of basic diaminotriphenylmethane dyes, basic triaminotriphenylmethane dyes, basic triaminodiphenylnaphthylmethane dyes and their reduction products; and B. sulfoalkyl sulfide compounds containing the grouping $RS_n$—Alk—$SO_3M$ where n is an integer 1 to 5, where M is one gram-equivalent of a cation, where —Alk— is a divalent aliphatic hydrocarbon group of 1 to 8 carbon atoms, and where R is selected from a group consisting of hydrogen, a metal cation, a monovalent hydrocarbon radical including one which carries inert substituents, a sulfonic group $MO_3S$— and a sulfolanyl group in an amount of 0.01 milligrams per liter to 1000 milligrams per liter.

26 Claims, No Drawings

ELECTRODEPOSITION OF COPPER

This application is a continuation in part of U.S. patent application Ser. No. 525,719, filed Nov. 21, 1974, now abandoned which in turn is a continuation in part of U.S. patent application Ser. No. 315,112 filed Dec. 12, 1972, now abandoned.

This invention relates to novel compositions and to a process for electrodepositing copper from an aqueous acidic copper plating bath containing at least one member from each of the following two groups:

A. from 0.005 to 1.0 gram per liter of at least one member of the group consisting of basic diaminotriphenylmethane dyes, basic triaminotriphenylmethane dyes, basic triaminodiphenylnaphthylmethane dyes, and their reduction products; and B. sulfoalkyl sulfide compounds containing the grouping $RS_n$—Alk—$SO_3M$ where n is an integer 1 to 5, where M is one gram-equivalent of a cation, where —Alk— is a divalent aliphatic hydrocarbon group of 1 to 8 carbon atoms, and where R is selected from a group consisting of hydrogen, a metal cation, a monovalent hydrocarbon radical including one which carries inert substituents, a sulfonic group $MO_3S$— and a sulfolanyl group in an amount of 0.01 milligrams per liter to 1000 milligrams per liter.

In many cases, especially when strongly leveling fully bright copper deposits are to be obtained, the presence of small amounts of halide ions, especially chloride ions, in the copper bath is necessary.

The basic triarylmethane dyes of this invention may be present in the copper bath of this invention in effective amounts of 0.005 gram per liter to 1.0 gram per liter of total aqueous bath composition.

Typical basic diaminotriphenylmethane, triaminotriphenylmethane and triaminodiphenylnaphthylmethane dyes which may be employed according to this invention include the following compounds which are summarized in Table I.

TABLE I

COOPERATING AMINES

1.

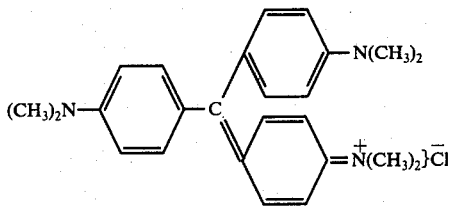

Crystal Violet

1R.

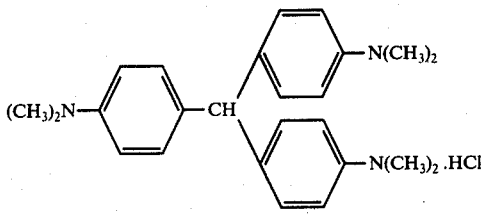

Reduction product of No. 1

2.

TABLE I-continued

COOPERATING AMINES

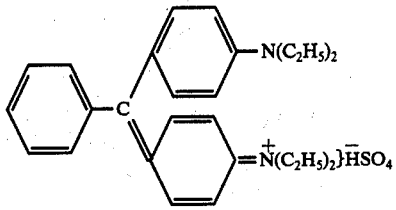

Basic Green I

3.

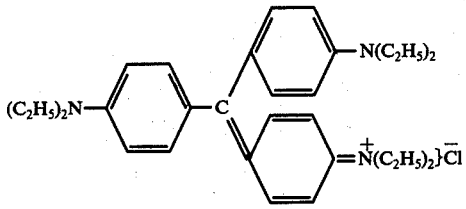

Ethyl Violet

4.

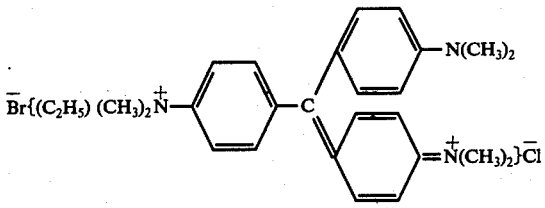

Methyl Green

5.

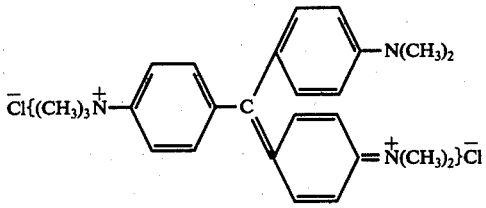

Basic Blue 20

6.

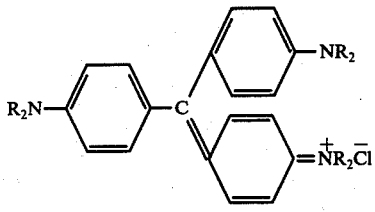

Benzyl Violet

A mixture in which 4, 5 or 6 of the substituents R are methyl groups and the remaining 2, 1 or zero substituents are benzyl groups.

7.

-continued

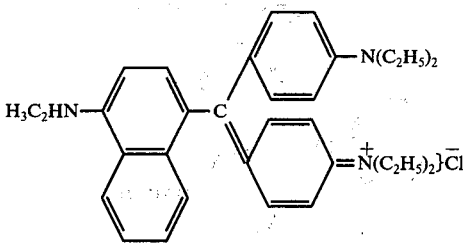

Basic Blue 7; Solvent Blue 5, free base.

8.

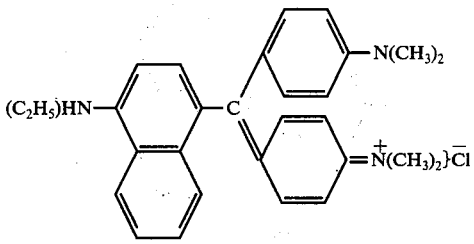

Basic Blue 11; Solvent Blue 6, free base.

9.

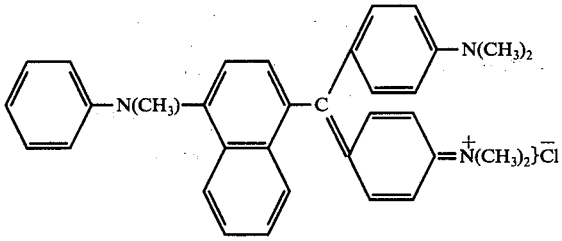

Basic Blue 8; Solvent Blue 2, free base.

10.

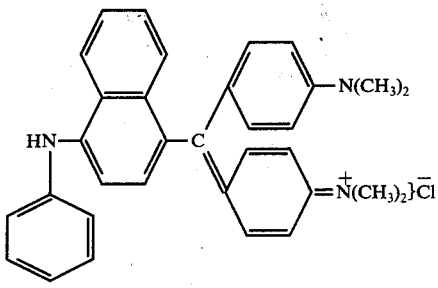

Basic Blue 26; Solvent Blue 4, free base.

All basic triarylmethane compounds of Table I co-operate with sulfoalkylsulfides such as those listed in Table II but their co-operation with leveling agents varies. Triphenylmethanes with unsubstituted amino groups show at 0.1 gram per liter and in combination with 0.015 gram per liter of SAS No. 1 little response to the addition of leveling agents such as 2-mercaptothiazoline. The methylated No. 1, and its reduction product 1R, shows some response to leveling agents, which is still better for the ethylated No. 2 and 3 (Examples 2 and 3), the benzylated No. 6 (Example 4) or partly quaternized dyes such as No. 4.

The diphenylnaphthylmethanes No. 7 and 8 show very good co-operation with sulfoalkylsulfides and leveling agents, even at only 0.05 gram per liter of the dye (Examples 5 and 6). Introduction of a third benzene ring into such triamino diphenylnaphthylmethanes, makes them rather "too strong". Even only 0.01 to 0.025 gram per liter of dye No. 9 produces pitted, badly covering copper deposit. Addition of sulfoalkylsulfides such as SAS No. 1 produces smooth, semi-bright deposits with good covering power and leveling properties even in absence of typical leveling agents, but response to leveling agents such as 2-mercaptothiazoline is negative, unless also a small amount of polyether is added (Example 7).

The cooperating sulfoalkylsulfides exhibit the formula:

$$RS_n - Alk - SO_3M$$

where $n = 1$ to 5, where M denotes one gram-equivalent of a cation and —Alk— is a divalent aliphatic group of 1–8 carbon atoms; —Alk— may be saturated or unsaturated divalent aliphatic hydrocarbon group, which may or may not carry inert substituents such as hydroxyl, alkyl, hydroxyalkyl, and alkoxy in which the carbon chain may be interrupted by heteroatoms. Typical examples of —Alk— are:

$-(CH_2)_m-$ where m is 1 to 8, $-CH_2CHOHCH_2-$, $-CH_2\underset{\underset{CH_2OH}{|}}{CH}-$, $-CH_2CH_2\overset{\overset{CH_3}{|}}{CH}-$, $-\overset{\overset{CH_3}{|}}{\underset{\underset{CH_3}{|}}{C}}-CH_2-\overset{\overset{CH_3}{|}}{CH}-$, In the compound $R—S_n—Alk—SO_3M$ R may be a hydrocarbon radical preferably selected from the group consisting of alkyl, alkenyl, alkynyl, cycloalkyl, aryl, aralkyl, alkaryl, including such radicals when substituted such as preferably sulfoalkyl. R may be a sulfoalkylthioalkyl group, such as $MO_3S—Alk—S_n—Alk—$, or $MO_3S—Alk—S_n—CH_2C_6H_4CH_2—$, or $MO_3S—Alk—S_n—CH_2C_6H_4OC_6H_4CH_2—$.

R may be hydrogen or a metal cation; it may be a sulfonic group $MO_3S—$ (e.g. in the reaction product of sodium thiosulfate and 1,3-propanesultone); or a 1,1-dioxytetrahydrothienyl (sulfolanyl) group;

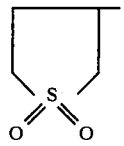

The sulfoalkylsulfides may be employed in effective amounts of 0.01 milligram per liter to 1000 milligrams per liter of total aqueous bath composition. Typical sulfoalkylsulfides which may be employed according to this invention include the following compounds which are summarized in Table II.

TABLE II

COOPERATING SULFOALKYL SULFIDES (SAS) OF THE FORMULA $RS_N—Alk—SO_3M$

| SAS No. | R | n | Alk | M |
|---|---|---|---|---|
| 1 | $NaO_3S(CH_2)3$ | 2 | $—(CH_2)_3—$ | Na |
| 2 | $NaO_3S(CH_2)3$ | 3 | $—(CH_2)_3—$ | Na |
| 3 | $NaO_3S(CH_2)4$ | 2 | $—(CH_2)_4—$ | Na |
| 4 | $C_6H5$ | 2 | $—(CH_2)_3—$ | Na |
| 5 | 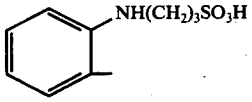 | 2 | $—(CH_2)3$ | Na |
| 6 | H | 1 | $—(CH_2)_2—$ | Na |
| 7 | H | 1 | $—(CH_2)_3—$ | Na |
| 8 | $NaO_3S$ | 1 | $—(CH_2)_3—$ | Na |
| 9 | $CH_3(CH_2)3$ | 2 | $—(CH_2)_3—$ | Na |
| 10 | $H_2C=CHCH2$ | 2 | $—(CH_2)_3—$ | Na |
| 11 | $HC\equiv CCH2$ | 2 | $—CH_2)_3—$ | Na |
| 12 | $NaO_3S(CH_2)3$ | 1 | $—(CH_2)_3—$ | Na |
| 13 | $NaO_3S(CH_2)_3S(CH_2)3$ | 1 | $—(CH_2)_3—$ | Na |
| 14 | $NaO_3S(CH_2)_3S(CH_2)6$ | 1 | $—(CH_2)_3—$ | Na |
| 15 | $C_6H5$ | 1 | $—(CH_2)_3—$ | Na |
| 16 | $C_6H_5CH2$ | 1 | $—(CH_2)_3—$ | Na |
| 17 | $NaO_3S(CH_2)_3S_2CH_2C\equiv CCH2$ | 2 | $—(CH_2)_3—$ | Na |
| 18 | $NaO_3SCH_2OHOHCH2$ | 2 | $—CH_2CHOHCH_2—$ | Na |
| 19 | 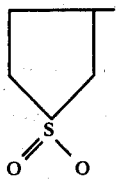 | 1 | $—(CH_2)_3—$ | Na |

Another aspect of this invention is the one of obtaining strongly leveled copper deposits, that is copper deposits which are substantially smoother than the substrate on which they are deposited. In order to possess leveling properties the acid copper plating bath must contain besides at least one member of each of the groups (A) and (B) also 0.1 to 50 milligrams per liter of at least one member of group (C) and/or (D) comprising the leveling agents, i.e. diffusion controlled inhibitors.

Besides producing leveling the leveling agent frequently also increases brightness, and widens the bright current density range. It may also prevent roughness formation at high current density.

An acid copper bath containing at least one additive from each of the two groups (A) and (B) responds much better to the addition of a leveling agent than a copper bath containing only members of one of the two groups of no members of these two groups.

Leveling agents of group (C) which cooperate very well with addition agents of groups (A) and (B) are those containing $$a—\underset{\underset{SH}{|}}{C}=N—\text{group or its tautomeric form } —\underset{\underset{S}{\|}}{C}—NH—.$$

These tautomeric groups may be a part of a noncyclic molecule, such as an open thiourea in which they become a part of the wider groups:

$$>N—\underset{\underset{SH}{|}}{C}=N— \text{ or } >N—\underset{\underset{S}{\|}}{C}—NH—$$

or they may be a part of heterocyclic rings where they may become a part of the wider groups:

$$>N—\underset{\underset{S}{\|}}{C}—NH—,\quad —S—\underset{\underset{S}{\|}}{C}—NH,$$

$$—O—\underset{\underset{S}{\|}}{C}—NH—,\quad =\overset{|}{C}—\underset{\underset{S}{\|}}{C}—NH—,$$

$$=\overset{|}{C}—\underset{\underset{S}{\|}}{C}—\underset{\underset{OH}{|}}{N}—$$

and/or their corresponding tautomeric forms.

Typical leveling agents of the open thiourea type operable in the practice of this invention are set forth in Table III of U.S. Pat. No. 3,682,788 which issued Aug. 8, 1972, upon the application of O. Kardos et al., e.g., thiourea, N-ethylthiourea (1-ethylthiourea), N,N'-diethylthiourea (1,3-diethylthiourea), N-phenylthiourea (1-phenylthiourea), etc.

Typical leveling agents of the heterocyclic type are set forth in Table III of U.S. Pat. No. 3,542,655 which issued Nov. 24, 1970, upon the application of O. Kardos et al., e.g., 2-thiazolidinethione (2-mercaptothiazoline), 2-imidazolidinethione(ethylenethiourea) and its N-hydroxyethyl derivative, 2-pyrimidinethiol (2-mercaptopyrimidine) and in Table III of U.S. Pat. No. 3,804,729 which issued Apr. 16, 1974, upon the application of O. Kardos et al., e.g. 2-mercaptopyridine, 2-mercapto-4-methylpyridine, 2-mercaptoquinoline, their N-oxides, and other derivatives in which the —SH group is replaced by -continued

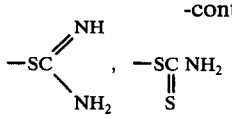

and similar groups.

Also levelers which instead of the group

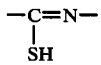

contain the corresponding mercury compound

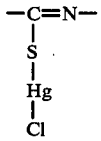

cooperate very well with the Amine plus Sulfoalkylsulfide combination.

Group (D) cooperating leveling and brightening agents comprise relatively high-molecular cations such as basic phenazine azo dyestuffs like Janus Green B (diethylphenosafranine azo dimethylaniline, Color Index No. 11050) or Janus Green (also Janus Green G, phenosafranine azodimethylaniline, Color Index No. 11045) or Janus Black (diethylphenosafranine azo phenol, C. I. Basic Black 2, Color Index No. 11825), and certain cationic polymers such as the polyalkyleneimines and their alkyl, hydroxyalkyl and sulfoalkyl derivatives of 1 to 4 carbon atoms and the polymers and copolymers of 2-vinylpyridine and/or 2-methyl-5-vinylpyridine and their quaternization products with alkyl halides of 1 to 4 carbon atoms, benzyl halides, or 1,3-propanesultone.

Simultaneous use of at least one member of each of these two types of leveling agents, together with at least one member of each of these two types of leveling agents, together with at least one member of each group (A) and (B), -imidazolidinethione(ethylenethiourea) in beneficial effects as compared with those obtained with levelers of only ore type, in respect to the degree 3,804,729 the current density range of brightness and leveling.

Still another type of compounds which often exerts beneficial effects when used in conjunction with compounds of the two groups (A) and (B), or with compounds of the three, respectively four, groups (A), (B), (C) and/or (D), are the polyethers (group E), especially those of rather high molecular weight. As low concentrations as 0.001 g/l to 0.005 g/l of a polyethyleneglycol of a molecular weight of 1000 or 6000 or 20,000, or of a nonylphenol condensate with 100 moles ethylene oxide, or of block polymers of 80% ethylene oxide and 20% propylene oxide and approximate molecular weight between 5,000 and 16,000, considerably increase leveling, especially in the low current density area, and often also increases brightness and bright current density range.

The polyether additives may be employed in amounts of 0.001 to 10 gram per liter.

The novel compositions of the invention are employed in combination with aqueous acidic copper plating baths. Typical aqueous acidic copper plating baths which may be employed in combination with the novel additive compositions of this invention include the following:

| | | |
|---|---|---|
| | SULFATE BATH | |
| (1) | $CuSO_4.5H_2O$ | 30–300 g/l |
| | $H_2SO4$ | 10–250 g/l |
| | $Cl^-$ | 0–150 mg/l |
| | FLUOBORATE BATH | |
| (2) | $Cu(BF_4)2$ | 50–600 g/l |
| | HBF4 | 1–300 g/l |
| | $H_3BO3$ | 0–30 g/l |
| | $Cl^-$ | 0–150 mg/l |

For the deposition of bright, leveling copper about 200 g/l of $CuSO_4.5H_2O$ or $Cu(BF_4)_2$, about 60 g/l of $H_2SO_4$ or 3.5 g/l of $HBF_4$, and about 20 to 80 mg/l of chloride ion are preferred. For high-speed plating, e.g., the plating of printing rolls, higher concentrations of the free acids and/or of the copper fluoborate are often preferred. For the plating of printed circuit boards, which requires high throwing power, low metal and high acid concentrations are most suitable.

The plating conditions for electrodeposition from the aforementioned baths may, for example, include temperatures of 10° C — 60° C (preferably 20° C – 40° C); pH (electrometric) of less than about 2.5; and a cathode current density of 0.1 –50.0 amperes per square decimeter. The higher temperature range is especially applicable for high speed plating at rather uniform current density and/or when maximum brightness and leveling are not required.

The substrates which may be electroplated in accordance with the process of this invention may include ferrous metals, such as steel, iron, etc., bearing a surface layer of nickel or cyanide copper; zinc and its alloys including zinc-base die-cast articles bearing a surface layer of cyanide copper or pyrophosphate copper; nickel, nickel alloys with other metals such as cobalt or iron; aluminum, including its alloys, after suitable pretreatment; and non-conducting materials, e.g., plastics, after suitable pretreatment, etc.

The following examples are set forth for the purpose of providing those skilled in the art with a better understanding of this invention, and the invention is not to be construed as limited to such examples.

The plating experiments reported in the following examples were performed, unless otherwise stated, in a Hull Cell Containing 250 ml of acid copper sulfate bath. The Hull Cell allows one to observe the appearance of the deposit over a wide current density range. In order to judge the degree of leveling the polished brass panels used for these plating tests were scratched with 4/0 emery polishing paper over a horizontal band of about 10 mm width. After the standard cleaning procedures and rinses the brass panels were generally given a short nickel strike from a Watt's nickel bath containing no addition agents, followed by thorough rinsing.

The plating temperature used in these experiments was the ambient room temperature (24°–40° C) unless otherwise stated. The total current was 2 amperes and the plating time 10 minutes. Air agitation was used in all cases. The amines used are listed in Table I, the sulfoalkylsulfides in Table II.

Two types of acid sulfate copper baths were used in these experiments:

| | | | | |
|---|---|---|---|---|
| | Type 1.) | Regular Sulfate Copper containing | | |
| | | $CuSO_4 . 5H_2O$ | 220 | g/l |
| | | $H_2SO4$ | 60 | g/l |
| | | Chloride ion | 0.06 | g/l |
| and | Type 2.) | High-Throw Sulfate Copper containing | | |
| | | $CuSO_4 . 5H_2O$ | 100 | g/l |
| | | $H_2SO4$ | 200 | g/l |
| | | Chloride ion | 0.06 | g/l |

The chloride concentrations indicated above are those after addition of the various additives as some amines of Table I contain chloride.

EXAMPLE 1

In an acid copper bath of Type 2 (High-Throw bath), 0.1 g/l of Amine (Basic Triarylmethane Dye) No. 1 or of its reduction product No. 1R or 0.04 g/l of Amine No. 7 gave matte slightly brittle copper deposits over most of the Hull Cell Current density range with excellent back coverage.

Addition of 0.015 g/l Sulfoalkylsulfide No. 1 produced a bright ductile copper deposit from about 3 amp/sq dm upwards for the Dye No. 1, and from about 1.2 amp/sq dm upwards for its reduction product No. 1R. In the latter case further addition of 0.001 g/l of N-ethylthiourea had a brightening effect especially in the low current density area but produced rather weak leveling.

Addition of 0.0075 g/l of Sulfoalkylsulfide No. 1 to the bath containing 0.04 g/l of Amine No. 7 gave a bright ductile copper deposit up to about 9 amp/sq dm.

All deposits maintained excellent back coverage.

EXAMPLE 2

In a copper bath of Type 1, 0.1 g/l of Amine No. 2 gave a non-uniform striated, partly semi-bright, mostly light to dark matte copper deposit in the Hull Cell.

Addition of 0.015 g/l of Sulfoalkylsulfide No. 1 produced a uniform bruggt copper deposit from about 1.2 amp/sq dm upwards. Further addition of 0.001 g/l 2-mercaptothiazoline widened the bright current density range down to about 0.4 amp/sq dm and produced substantial leveling. Final addition of 0.0025 g/l of Pluronic 10R8 (a block polymer having a polyoxyethylene group of approximate molecular weight 4000 in the center and two polyoxypropylene groups, each of approximate molecular weight 500, on either end) strongly increased leveling and extended the bright current density range over the whole Hull Cell panel.

The combination of 0.1 g/l of Amine No. 2 and 0.015 g/l Sulfoalkylsulfide No. 1 showed also good cooperation with 0.015 g/l of Janus Green or with a combination of 0.008 g/l of Janus Green and 0.001 g/l 2-mercaptothiazoline or with 0.01 g/l of poly-2-vinyl pyridine of an approximate molecular weight of 40,000 quaternized with propanesultone or with 0.010 g/l of poly-2-methyl-5-vinylpyridine quaternized with an alkylchloride. These four combinations gave well leveling copper deposits which were bright over almost the whole current density range.

0.1 g/l of Amine No. 2 showed also good cooperation with 0.02 g/l of SAS No. 4 or 5 or 7 or 9 or 10, or 0.04 to 0.08 g/l of SAS No. 12, 0.08 g/l of SAS No. 14, 0.04 g/l of No. 16, 0.08 g/l of No. 19. These double combinations generally showed also cooperation with at least one type of leveling agent.

EXAMPLE 3

In a copper bath of Type 1, 0.1 g/l of Amine No. 3 gave a dark matte deposit over most of the current density range with strong striations above 8 amp/sq dm. Addition of 0.015 g/l of SAS No. 1 produced a uniform bright copper deposit from 1 amp/sq dm upwards. Addition of 0.003 g/l of 2-mercapto-4-methylpyridine improved leveling and final addition of 0.0025 g/l of Pluronic 10R8 strongly increased leveling and bright current density range.

Cooperation of 0.1 g/l of Amine No. 3 with 0.02 g/l of SAS No. 11 or No. 17 was even slightly better, but tolerance for the leveling agent was less good.

EXAMPLE 4

In a copper bath of Type 1, 0.1 g/l of Amine No. 6, when used as the sole addition agent, produced a dark matte cooper deposit over most of the current density range with strong striations above about 7 amp/sq dm but excellent low current density and back coverage. 0.04 g/l (as well as 0.2 g/l) of SAS No. 16, when used as the only addition agent, produced a non-uniform light matte to dark matte copper electrodeposit with bad low current density coverage.

Combination of 0.1 g/l of Amine No. 6 and 0.04 g/l of SAS No. 16 produced a bright copper deposit above about 2.5 amp/sq dm and a semi-bright deposit below this current density.

Further addition of 0.10 g/l of Janus Green or 0.002 g/l of 2-mercaptothiazoline widened the bright current density range and strongly increased leveling.

EXAMPLE 5

In a copper bath of Type 1, 0.05 g/l of Amine No. 7 gave a matte copper deposit over most of the current density range which was strongly striated from about 4 amp/sq dm upwards.

Addition of 0.015 g/l of SAS No. 1 or 0.04 g/l of SAS No. 12 produced smooth deposits which were bright from about 1 amp/sq dm upwards and semi-bright below this current density.

Further addition of 0.0015 g/l of 2-mercaptothiazoline increased leveling and bright current density range. The combination of 0.05 g/l of Dye No. 7, 0.015 g/l of SAS No. 1 and 0.015 g/l of Janus Green produced a strongly leveled bright copper deposit over almost the whole current density range.

EXAMPLE 6

0.05 g/l of Amine No. 8 produced in an acid copper batch of Type 1 a copper deposit which was semi-bright below 0.2 amp/sq dm and uniform light matte above this current density. Further addition of 0.015 g/l SAS No. 1 produced a uniform bright deposit from about 1.4 amp/sq dm upwards. Addition of either 0.002 g/l of 2-mercaptothiazoline or of 0.015 g/l of Janus Green increased leveling and extended the bright current density range over the whole Hull Cell panel. Further addition of 0.0025 g/l of Pluronic 10R8 strongly enhanced leveling in either combination from about 0.8 amp/sq dm upwards.

Also the combination of 0.05 g/l of Amine No. 8, 0.015 g/l SAS No. 1 and 0.004 g/l of ethoxylated polyethyleneimine (approximate MW= 60,000) gave a bright copper deposit over almost the whole current density range with moderately good leveling.

EXAMPLE 7

0.025 g/l of Dye No. 9 gave, in a Type 1 bath, a very pitted, rough, matte copper deposit with almost no coverage of the Hull Cell panel below about 1 amp/sq dm. Addition of 0.015 g/l of SAS No. 1 produced a smooth semibright copper deposit over the whole current density range with good low current density coverage and considerable leveling power although no typical leveling agents were present.

However, further addition of 0.001 g/l of the leveling agent 2-mercaptothiazoline produced striations above about 4 amp/sq dm which disappeared only on addition of 0.0025 g/l of Pluronic 10R8.

Even 0.01 g/l of Dye No. 9 produced a matte, somewhat pitted copper deposit with bad low current density coverage. It cooperated with 0.015 g/l of SAS No. 1 to produce a smooth, semi-bright leveling deposit from about 1.3 amp/sq dm upwards, but further addition of 0.001 g/l of 2-mercaptothiazoline narrowed the semi-bright current density range strongly without increasing leveling.

While the invention has been described and illustrated in detail, it is clearly to be understood that this is intended to be of example only and is not to be taken to be of limitation, the spirit and scope of the invention being limited only by the terms of the following claims.

We claim:

1. A process for electrodepositing copper from an aqueous acidic copper plating bath containing at least one member independently selected from each of the following two groups:

A. from 0.005 to 1.0 gram per liter of at least one member of the group consisting of basic diaminotriphenylmethane dyes, basic triaminotriphenylmethane dyes, basic triaminodiphenylnaphthylmethane dyes, and their reduction products; and B. sulfoalkyl sulfide compounds containing the grouping $RS_n$—Alk—$SO_3M$ where n is an integer 1 to 5, where M is one gram-equivalent of a cation, where —Alk— is a divalent aliphatic hydrocarbon group of 1 to 8 carbon atoms, and where R is selected from a group consisting of hydrogen, a metal cation, a monovalent hydrocarbon radical including one which carries inert substituents, in which no carbon atom is bound exclusively to heteroatoms, a sulfonic group $MO_3S$— and a sulfoanyl group in an amount of 0.01 milligrams per liter to 1000 milligrams per liter.

2. The process of claim 1 wherein said basic triaminotriphenylmethane dye is Crystal Violet:

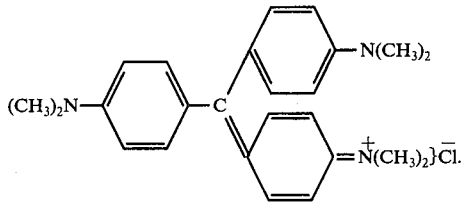

3. The process of claim 1 wherein said basic triaminotriphenylmethane compound exhibits the formula:

-continued

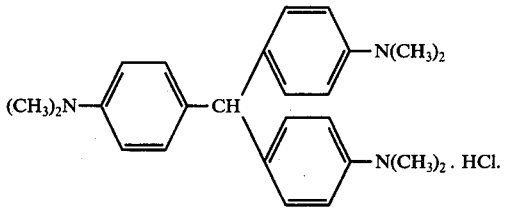

4. The process of claim 1 wherein said basic diaminotriphenylmethane dye exhibits the formula:

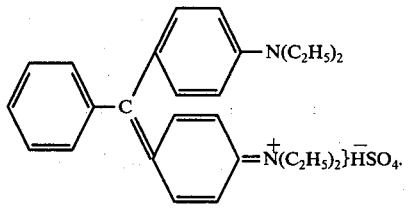

5. The process of claim 1 wherein said basic triaminotriphenylmethane dye exhibits the formula:

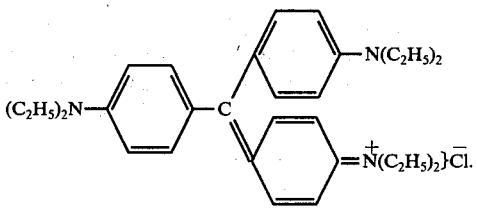

6. The process of claim 1 wherein said basic triaminotriphenylmethane dye exhibits the formula:

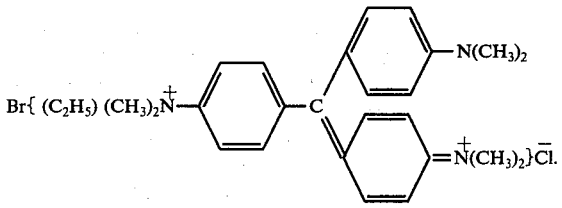

7. The process of claim 1 wherein said basic triaminotriphenylmethane dye exhibits the formula:

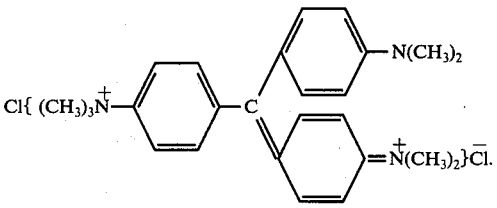

8. The process of claim 1 wherein said basic triaminotriphenylmethane dye is of the formula:

-continued

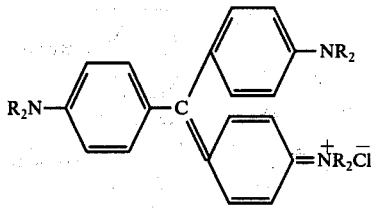

in which 4, 5 or 6 of the substituents R are methyl groups and the remaining 2, 1 or 0 substituents respectively, are benzyl group.

9. The process of claim 1 wherein said basic triaminodiphenylnaphthylmethane dye exhibits the formula:

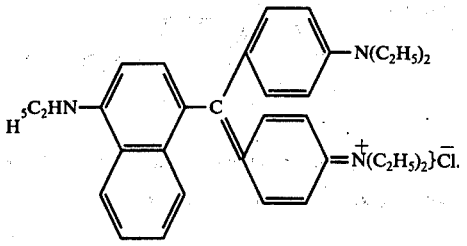

10. The process of claim 1 wherein said basic triaminodiphenylnaphthylmethane dye exhibits the formula:

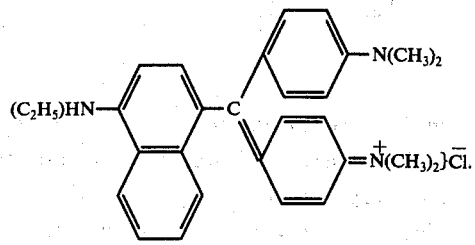

11. The process of claim 1 wherein said basic triaminodiphenylnaphthylmethane dye exhibits the formula:

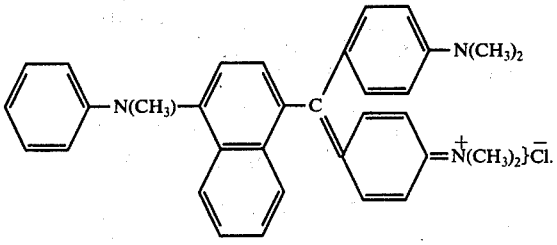

12. The process of claim 1 wherein said basic triaminodiphenylnaphthylmethane dye exhibits the formula:

-continued

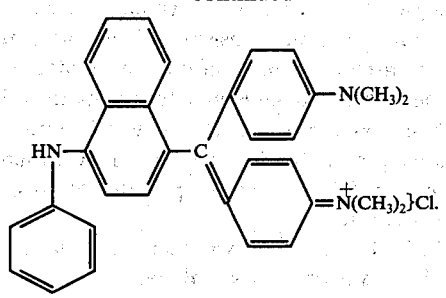

13. A process for electrodepositing copper from an aqueous acidic copper plating bath containing at least one member independently selected from each of the following two groups (A) and (B):

A. from 0.005 to 1.0 gram per liter of at least one member of the group consisting of basic diaminotriphenylmethane dyes, basic triaminotriphenylmethane dyes, basic triaminodiphenylnaphthylmethane dyes, and their reduction products; and B. sulfoalkyl sulfide compounds containing the grouping $RS_n$—Alk—$SO_3M$ where n is an integer 1 to 5, where M is one gram-equivalent of a cation, where —Alk— is a divalent aliphatic hydrocarbon group of 1 to 8 carbon atoms, and where R is selected from a group consisting of hydrogen, a metal cation, a monovalent hydrocarbon radical including one which carries inert substituents, in which no carbon atom is bound exclusively to heteroatoms, a sulfonic group $MO_3S$— and a sulfolanyl group in an amount of 0.01 milligrams per liter to 1000 milligrams per liter;

and at least one member independently selected from at least one of the following three groups (C), (D) and (E) where C. is an organic compound which contains at least one group $-\underset{\underset{SH}{|}}{C}=N-$ or its tautomer $-\underset{\underset{S}{\|}}{C}-NH-$ in an amount of 0.1 to 50 milligrams per liter;

D. is a cationic organic compound of a molecular weight greater than about 500 selected from the group consisting of phenazine azo dyes, polyethyleneimines, alkylated, hydroxyalkylated and sulfoalkylated polyethyleneimines, polyvinylpyridine, polyvinylalkylpyridines, and their quaternization products in an amount of 0.1 to 50 milligrams per liter; and E. is a polyether containing at least five ether atoms per molecule exhibiting molecular weights between 300 and 5,000,000, in an amount of 0.001 to 10 grams per liter.

14. An aqueous acidic copper electroplating bath containing at least one member independently selected from each of the following two groups:

A. from 0.005 to 1.0 gram per liter of at least one member of the group consisting of basic diaminotriphenylmethane dyes, basic triaminotriphenylmethane dyes, basic triaminodiphenylnaphthylmethane dyes, and their reduction products; and B. sulfoalkyl sulfide compounds containing the grouping $RS_n$—Alk—$SO_3M$ where n is an integer 1 to 5, where M is one gram-equivalent of a cation, where —Alk— is a divalent aliphatic hydrocarbon group of 1 to 8 carbon atoms, and where R is selected from a group consisting of hydrogen, a metal cation, a monovalent hydrocarbon radical including one which carries inert substituents, in which no carbon atom is bound exclusively to heteroatoms, a sulfonic group $MO_3S$— and a sulfolanyl group in an amount of 0.01 milligrams per liter to 1000 milligrams per liter.

15. The bath of claim 14 wherein said basic triaminotriphenylmethane dye is Crystal Violet:

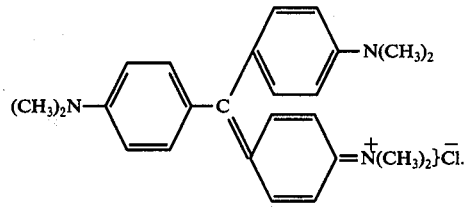

16. The bath of claim 14 wherein said basic triaminotriphenylmethane compound exhibits the formula:

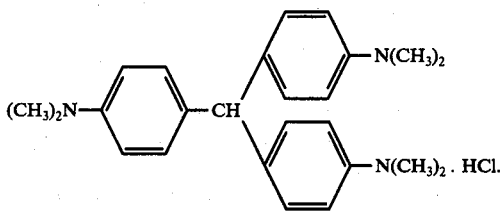

17. The bath of claim 14 wherein said basic diaminotriphenylmethane dye exhibits the formula:

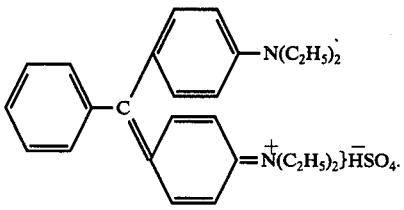

18. The bath of claim 14 wherein said basic triaminotriphenylmethane dye exhibits the formula:

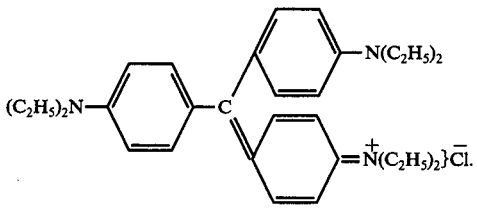

19. The bath of claim 14 wherein said basic triaminotriphenylmethane dye exhibits the formula:

-continued

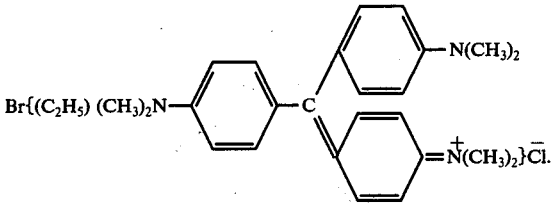

20. The bath of claim 14 wherein said basic triaminotriphenylmethane dye exhibits the formula:

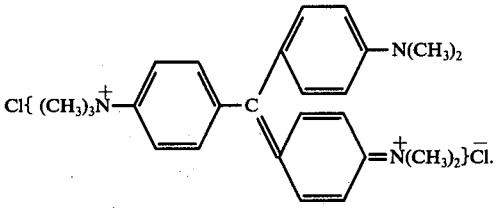

21. The bath of claim 14 wherein said basic triaminotriphenylmethane dye is of the formula:

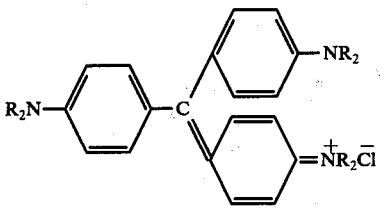

in which 4, 5 or 6 of the substituents R are methyl groups and the remaining 2, 1 or 0 substituents, respectively, are benzyl group.

22. The bath of claim 14 wherein said basic triaminodiphenylnaphylmethane dye exhibits the formula:

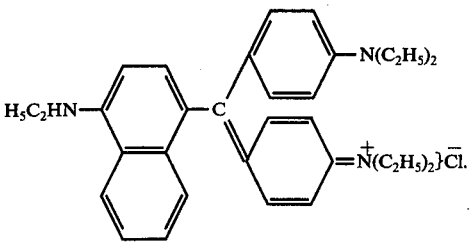

23. The bath of claim 14 wherein said basic triaminodiphenylnaphthylmethane dye exhibits the formula:

-continued

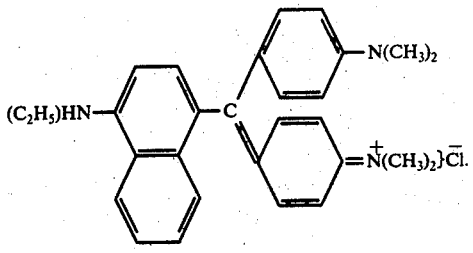

24. The bath of claim 14 wherein said basic triaminodiphenylnaphthylmethane dye exhibits the formula:

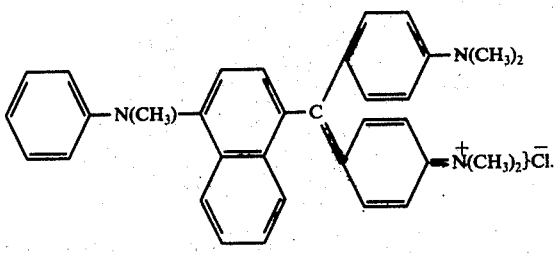

25. The bath of claim 14 wherein said basic triaminodiphenylnaphthylmethane dye exhibits the formula:

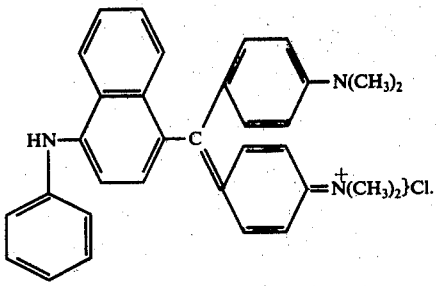

26. An aqueous acidic copper electroplating bath containing at least one member independently selected from each of the following two groups (A) and (B):

A. from 0.005 to 1.0 gram per liter of at least one member of the group consisting of basic diaminotriphenylmethane dyes, basic triaminotriphenylmethane dyes, basic triaminodiphenylnaphthylmethane dyes, and their reduction products; and B. sulfoalkyl sulfide compounds containing the grouping $RS_n$—Alk—$SO_3M$ where n is an integer 1 to 5, where M is one gram-equivalent of a cation, where —Alk— is a divalent aliphatic hydrocarbon group of 1 to 8 carbon atoms, and where R is selected from a group consisting of hydrogen, a metal cation, a monovalent hydrocarbon radical including one which carries inert substituents, in which no carbon atom is bound exclusively to heteroatoms, a sulfonic group $MO_3S$— and a sulfolanyl group in an amount of 0.01 milligrams per liter to 1000 milligrams per liter;

and at least one member independently selected from at least one of the following three groups (C), (D) and (E) where C. is an organic compound which contains at least one group $-\underset{\underset{SH}{|}}{C}=N-$ or its tautomer $-\underset{\underset{S}{\|}}{C}-NH-$ in an amount of 0.1 to 50 milligrams per liter;

D. is a cationic organic compound of a molecular weight greater than about 500 selected from the group consisting of phenazine azo dyes, polyethyleneimines, alkylated, hydroxyalkylated and sulfoalkylated polyethyleneimines, polyvinylpyridine, polyvinylalkylpyridines, and their quaternization products in an amount of 0.1 to 50 milligrams per liter; and E. is a polyether containing at least five ether atoms per molecule exhibiting molecular weights between 300 and 5,000,000 in an amount of 0.001 to 10 grams per liter.

* * * * *